US006857386B2

(12) United States Patent
Brewer

(10) Patent No.: US 6,857,386 B2
(45) Date of Patent: Feb. 22, 2005

(54) FLAG FASTENING ASSEMBLY

(76) Inventor: Omer Francis Brewer, c/o Brewer Design Service, Inc., P.O. Box "B", Shelbyville, IN (US) 46176

( * ) Notice: Subject to any disclaimer, the term of this patent is extended or adjusted under 35 U.S.C. 154(b) by 0 days.

(21) Appl. No.: 10/412,531

(22) Filed: Apr. 11, 2003

(65) Prior Publication Data

US 2004/0200402 A1 Oct. 14, 2004

(51) Int. Cl.[7] ..... G09F 17/00
(52) U.S. Cl. ..... 116/174; 116/173
(58) Field of Search ..... 116/173, 174; D11/165, 166; 248/218.4; 40/422, 479; 403/34, 209, 210; 24/127, 122.6, 129 A

(56) References Cited

U.S. PATENT DOCUMENTS 1,855,824 A * 4/1932 Crichton ..... 116/173
D111,781 S * 10/1938 Frazier ..... D11/166
3,417,732 A * 12/1968 Platt, Jr. ..... 116/173
4,864,962 A * 9/1989 Kuehl et al. ..... 116/174
5,568,784 A * 10/1996 Willis et al. ..... 116/173
6,155,018 A * 12/2000 Yang ..... 52/736.4

FOREIGN PATENT DOCUMENTS

JP 04146481 A * 5/1992 ..... G09F/17/00
JP 2004157194 A * 6/2004 ..... G09F/17/00

* cited by examiner

*Primary Examiner*—Diego Gutierrez
*Assistant Examiner*—R. Alexander Smith

(57) ABSTRACT

Flag fastening assembly for fastening the upper and lower portion of the leading edge of a flag to a flag supporting member in a manner that balances the weight of the flag about the axis of the flag supporting member and prevents furling. Each flag fastening assembly includes the combination of a swivel that is positioned longitudinally on the flag supporting member by set screws, each swivel including an outwardly extending member with spaced apart holes near an outer edge thereof and a cord member attached through such holes and linked through a grommet near an adjacent inner corner of the flag. The grommet lies in a plane that is substantially orthogonal to the cord as the flag flies in the wind.

17 Claims, 2 Drawing Sheets

FLAG FASTENING ASSEMBLY

REFERENCES CITED

U.S. Pat. Nos: (Included with this application)

| | | |
|---|---|---|
| 3,792,680 | Allen | Feb. 19, 1974 |
| 2,799,240 | Andrews | Jul. 16, 1957 |
| 3,680,526 | Buffington, Jr. | Aug. 1, 1972 |
| 5,615,635 | Deviney | Apr. 1, 1997 |
| 5,375,555 | Dolan | Dec. 27, 1994 |
| 5,315,955 | Feliz | May 31, 1994 |
| 3,183,886 | Moffit, Jr. | May 18, 1965 |
| 4,679,523 | Orero | Jul. 14, 1987 |
| 5,039,048 | Paxton | Aug. 13, 1991 |
| 4,103,642 | Swenson | Aug. 1, 1978 |
| 4,603,652 | Thibault | Aug. 5, 1986 |
| 410,221 | Thompson | Sep. 3, 1889 |
| 3,595,202 | Visitacion | Jul. 27, 1971 |
| 1,631,567 | Walton | Jun. 7, 1927 |

1. Field of Invention

This invention relates to fasteners for attaching flags to flag supporting members.

2. Discussion of Prior Art

The flag fasteners from a flag supporting member to the flag are generally heavy, cumbersome, expensive and difficult to attach. Most are cantilevered from the center of the flag supporting member in only one direction, not balanced. The header of the flag is generally held taut and the flag fasteners are difficult to remove from the flag supporting member. The halyard is often attached directly to the flag, preventing the upper and lower portion of the flag to react independently to the wind.

U.S. Pat. No. 3,792,680, Allen, Feb. 19, 1974. All the weight of the flag is cantilevered from one side of the flag supporting member and the weight of the flag is not balanced about the axis of the flag supporting member as the flag rotates. The connection is not free to rise and fall with the wind currents, but are held within a groove.

U.S. Pat. No. 2,799,240, Andrews, Jul. 16, 1957. All the weight of flag is cantilevered from one side of the flag supporting member and the weight of the flag is not balanced about the axis of the flag supporting member as the flag rotates. The flag is held in a taut position and swiveled from an unbalanced cantilevered rigid member. The flag is attached directly to the halyard adding stress to the flag fabric, and the halyard attachments. The attachments are not free to move up or down.

U.S. Pat. No. 3,680,526, Buffington, Jr., Aug. 1, 1972. All the weight of flag is cantilevered from one side of the flag supporting member and the weight of the flag is not balanced about the axis of the flag supporting member as the flag rotates. The flag is attached to a tube which rotates about a flag pole. The tube is attached to a halyard through swivel rims. The swivel rims are attached to the halyard from only one cantilevered side, putting more pressure on one side of the swivel. The device requires the use of a halyard and pulley. The swivel is prevented from rising and falling with the wind.

U.S. Pat. No. 5,615,635, Deviney, Apr. 1, 1997. All the weight of the flag is cantilevered from one side of the flag supporting member and the weight of the flag is not balanced about the axis of the flag supporting member as the flag rotates. The flag is attached completely along the inner edge to a tube of equal length. The flag is not rotatable on the tube, and the tube which rotates around the flag pole is not laterally movable to various positions.

U.S. Pat. No. 5,375,555, Dolan, Dec. 27, 1994. All the weight of the flag is cantilevered from one side of the flag supporting member and the weight of the flag is not balanced about the axis of the flag supporting member as the flag rotates. The flag is attached to a swivel that is cantilevered from only one side of a flag pole; the swivel is restrained from moving horizontally with the flag pole, reducing the freedom of the flag to fly freely. With the weight of the flag all on the top connection, the lower flag connection is free to rotate around the pole, but not the top of the flag, causing the flag to wrap.

U.S. Pat. No. 5,315,955, Feliz, May 31, 1994. All the weight of the flag is cantilevered from one side of the flag supporting member and the weight of the flag is not balanced about the axis of the flag supporting member as the flag rotates. The device requires a rope and pulley to function. The flag connections are expensive to manufacture. The flag is spaced away from the flag pole to prevent the halyard from contacting the flag pole and causing noise. The flag is unable to rotate completely around the flag pole and would not function in all positions.

U.S. Pat. No. 3,183,886, Moffit, Jr., May 18, 1965. All the weight of the flag is cantilevered from one side of the flag supporting member and the weight of the flag is not balanced about the axis of the flag supporting member as the flag rotates. The flag is held in a taut position on the inner edge by a device that is cantilevered out from only one side of the flagpole. The top and bottom are tied together by the rod, preventing the bottom of the flag from reacting differently to the top of the flag. This would be difficult to rotate around a flag pole in a horizontal or angular position due to the weight.

U.S. Pat. No. 4,679,523, Orero, Jul. 14, 1987. All the weight of the flag is cantilevered from one side of the flag supporting member and the weight of the flag is not balanced about the axis of the flag supporting member as the flag rotates. The flag inner edge is held in a taut position; it would be difficult to change the flag. The flag is attached to a tube which cannot rotate without being stopped by the halyard. The tube is not attached to the flagpole.

U.S. Pat. No. 5,039,048, Paxton, Aug. 13, 1991. All the weight of the flag is cantilevered form one side of the flag supporting member and the weight of the flag is not balanced about the axis of the flag supporting member as the flag rotates. The flag attaching device prevents the device and the flag from rotating completely around the pole. This would not function as tangle free in a horizontal or angular position.

U.S. Pat. No. 4,103,642, Swenson, Aug. 1, 1978. All the weight of the flag is cantilevered from one side of the flag supporting member and the weight of the flag is not balanced about the axis of the flag supporting member as the flag rotates. This is a complicated, expensive device to manufacture and not suitable for small flag pole use. The flag would come in contact with the halyard and requires a halyard and pulley to function.

U.S. Pat. No. 4,603,652, Thibault, Aug. 5, 1986. All the weight of the flag is cantilevered from one side of the flag supporting member and the weight of the flag is not balanced about the axis of the flag supporting member as the flag rotates. The attachment is cantilevered from one side and attached to a rotatable tube. The attachments are rigidly attached to the flag and are permanently in line, reducing the action of the flag.

U.S. Pat. No. 410,221, Thompson, Sep. 3, 1889. All the weight of the flag is cantilevered form one side of the flag supporting member and the weight of the flag is not balanced about the axis of the flag supporting member as the flag rotates. The standard grommets of a flag are replaced by using a tube that is riveted to the flag; a spindle inside the tube has an eyelet for a halyard connection. The flag rotates about the spindle, it does not allow the flag to continually rotate about the flag pole. The stress placed on the tube when the spindle is pulled by the halyard would create friction, thus binding. It would be difficult to change the flag.

U.S. Pat. No. 3,595,202, Visitacion, Jul. 27, 1971. All the weight of the flag is cantilevered from one side of the flag supporting member and the weight of the flag is not balanced about the axis of the flag supporting member as the flag rotates. The attachments are of rigid construction, inline and surrounding a tube that requires a halyard to raise the tube from a flagpole.

U.S. Pat. No. 1,631,567, Walton, Jun. 7, 1927. All the weight of the flag is cantilevered from one side of the flag supporting member and the weight of the flag is not balanced about the axis of the flag supporting member as the flag rotates. The flag is attached to the halyard, putting stress on the inner edge of the flag. The device requires a rope and pulley to function. The sleeved device supporting the flag has to rotate around a pole in response to the wind currents. Not designed to function in all positions.

Catalogs of Flags, Flagpoles and Attachments and Accessories:

Annin & Co., Roseland N.J.

Eder Flag Mfg. Co, Inc. Oak Creek, Wis.

PLP Composite Technologies, Inc., Fitzwilliam N.H.

American Legion Emblem Sales, Indianapolis, Ind.

VFW Emblem & Supply, Kansas City, Mo.

SUMMARY AND OBJECTS OF THE INVENTION

Applicant's invention of a simple fastening assembly to prevent a flag from tangling around a flag supporting member solves numerous shortfalls in other patents. The fastening assembly distributes the weight of the flag about the axis of the flag supporting member while the flag is propelled around the flag supporting member by the forces of the wind. The fastener is a rotatable balancing mechanism equalizing the weight about the axis of the supporting member.

The fastening assembly can be used with or without an ornament at the end of a flag pole. The fastening assembly is lightweight, inexpensive to manufacture, simple to attach or remove and provides a means for the flag to be flown in all positions without tangling.

An object of the invention is to provide a fastening assembly that equally distributes the weight of the flag about the axis of the flag supporting member to prevent tangling of the flag when displayed in a horizontal, vertical or angular position.

Another object of the invention is to provide a fastening assembly that can be mounted on a flag supporting member that is placed in a flag pole holder where no halyard would be required and the flag and fastening assembly could be quickly exchanged.

Another object is for the fastening assembly to be easily moved laterally on the flag supporting member to fly the flag at half staff.

Another object is to eliminate the rotating truck at the top of the flag supporting member.

Another object is to provide a fastening assembly with a flag supporting member that is less costly to store and to ship.

Another object is to provide a way to raise the flag while attached to a flag supporting member without the halyard coming into contact with the flag and with no stress being put on the flag by the halyard.

Another object is to provide a way for the flag supporting member to be removed from the halyard while the flag supporting member is attached to the flag.

Another object is to provide a fastening assembly that is very small and light in weight for attaching a flag to a flag supporting member that may be easily raised, lowered or moved by a halyard.

REFERENCE NUMBERS IN DRAWINGS

2. Flag fastening assembly

4. Swivel

6. Flag supporting member

8. Flag pole holder

10. Ornament

12. Upper end

14. Flag or banner

16. Grommet

18. Cord

20. Outwardly extending member

22. Car-key type ring

24. Halyard

26. Set screw

DESCRIPTION OF THE INVENTION

Figure 1:
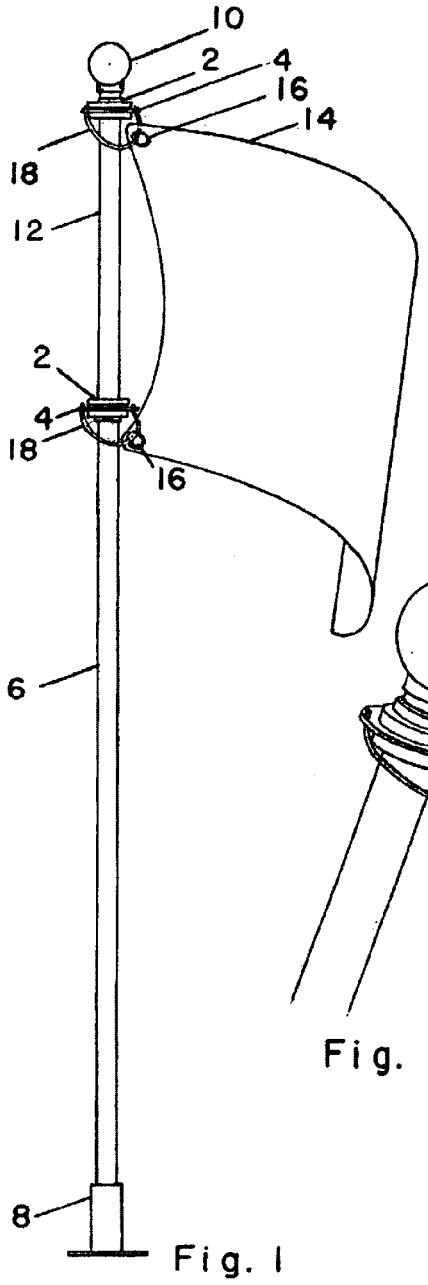
FIG. 1 is a general elevational view of a flying flag attached to a supporting member in accordance with this invention.

Referring to FIG. 1 a flag fastening assembly (2) embodying the present invention. The flag fastening assembly (2) includes a swivel (4) constructed in accordance with the present invention and is shown mounted to a flag supporting member (6) at a selected level on the flag supporting member (6) which is mounted to a flag pole holder (8). The flag pole holder (8) is fastened to a surface by screws, bolts or the like. An ornament (10) is attached to an upper end (12) of the flag supporting member (6). A flag or banner (14) having a grommet (16) located in the leading edge at an upper and a lower portion of the flag (14) is attached to the flag supporting member (6) with a cord (18). The flag fastening assembly (2) attaching the lower portion of the flag is arranged as an inverted mirror image of the fastening assembly attaching the upper portion of the flag (14). The flag fastening assembly (2) attaching the lower portion of the flag (14) will work equally well as arranged to attach the upper portion of the flag to the flag supporting member (6).

Figure 2:
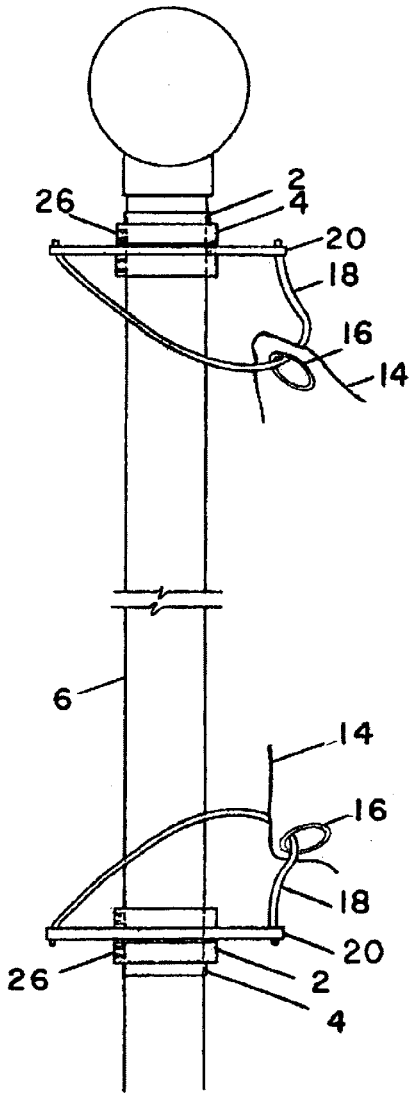
FIG. 2 is an enlarged side view showing both the upper and lower fastening assemblies.

As shown in FIG. 2 the flag fastening assembly (2) attaching the upper grommet (16) of the flag (14) to the flag supporting member (6) includes a suitable swivel (4) having an outwardly extending member (20). The swivel (4) is in the form of a ring having two identical parts, and when one part is placed above the other, they form an external annular channel for the outwardly extending member (20) in the form of a flange to rotate about. The outwardly extending member (20) is preferably round, oval or parallelogram shaped with all corners rounded off. The outwardly extending member (20) is preferably flat, thin and lightweight, however it must be strong enough to support the weight of the flag (14). While the flag (14) is rotatably propelled around the flag supporting member (6) by the forces of the wind upon the flag (14), a minimum of deflection of the outwardly extending member (20) is preferred. The material of the outwardly extending member (20) is preferably anodized aluminum; however, a fiberglass, nylon or plastic that is ultra violet light stable and has the means to withstand sudden jolts and angular stress may also be used. The outwardly extending member (20) has a central hole allowing the outwardly extending member (20) to be placed over the flag supporting member (6) and freely between the two ring parts of the swivel (4).

The central hole of the outwardly extending member (20) can be contoured to provide the least amount of friction, while rotating around the flag supporting member (6). The central hole can be contoured to provide any number of contact points.

Each ring part has an inside diameter to slide over the flag supporting member (6). The outside diameter of each ring part is stepped to provide a flat surface (4*a*) for the outwardly extending member (20) to rotate on and a circular surface (4*b*) for the outwardly extending member (20) to rotate freely about. The width of the circular surface is to be greater than the thickness of the outwardly extending member (20) to provide clearance between the two ring parts and the outwardly extending member (20). The ring parts have attaching means to the flag supporting member (6) in the form of a set screw (26) located in the outer periphery of each ring part to prevent rotation and provide lateral movement. The ring parts when mounted one above the other provide a channel (4*c*) for the outwardly extending member (20) and also prevent the outwardly extending member (20) from contacting the flag supporting member (6) while maintaining the proper location between the grommets (16) of the flag (14). The ring parts can be moved longitudinally about the axis of the flag supporting member (6) to accommodate the width of various flags (14). The ring parts can also be arranged on the flag supporting member (6) to display the flag (14) in a half staff position. The material of the ring parts is lightweight and non-corrosive, preferably a nylon, fiberglass or other plastic that is ultra violet light stable and has the means to withstand constant abrasion.

The outwardly extending member (20) has two spaced apart small holes, substantially equally spaced and in line with the central hole, and located near an outer edge of the outwardly extending member (20). A cord, cable, rope, ball and link chain or other flexible member having two ends (18) attaches the grommet (16) to the outwardly extending member (20). One end of the cord (18) is attached to one of the spaced apart holes, and the opposite end passes through the grommet and is attached to the other spaced apart hole in the swivel means. The small holes are then swaged against the cord (18), thereby attaching the cord (18) to the swivel (4).

Other ways of attaching the cord (18) to the swivel (4) could be used, such as knotting the ends of the cord, using various clamps that are permanent or those that are releasable.

The purpose of the spaced apart holes being equally spaced from the central hole of the outwardly extending member (20) is to balance the weight of the flag (14) equally about the axis of the flag supporting member (6). The spaced apart holes equalize the pressure to both sides of the swivel (4). The balancing of the swivel (4) prevents any tilting or binding of the swivel (4) that would obstruct the rotation of the flag. The flag is free to rotate, thus eliminating furling, wrapping or tangling of the flag (14). The flag fastening assemblies (2) are mounted to the flag supporting member (6) with the cord ends facing away from the flag. The flag fastening assemblies (2) are positioned at a selected level on the flag supporting member (6).

The lower grommet (16) of the flag (14) may also be attached to the outwardly extending member (20) by passing one end of the cord (18) through the grommet (16), then through only one of the holes in the outwardly extending member (20) and connecting the ends of the cord (18) together. With the flag (14) attached to the outwardly extending member (20) in this manner, the weight of the flag is still supported, and balanced with the upper flag fastening assembly (2).

Figure 3:
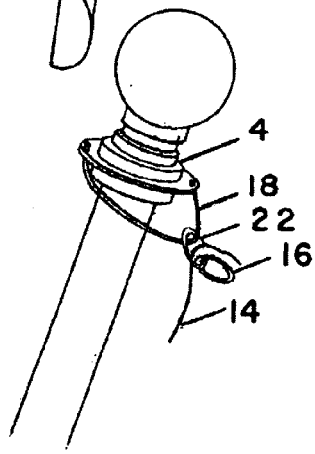
FIG. 3 is a perspective view of an alternative embodiment showing an additional car-key type ring included as part of the flag fastening assembly.

As shown in FIG. 3, an additional car-key type ring (22) is shown, wherein the loops can be temporarily spread apart adjacent one end of a coil to enable its insertion through the grommet (16). The cord (18) would then pass through the car-key type ring (22) rather than through the grommet (16) as shown in FIG. 2, thus allowing the flag (14) to be removed without detaching the cord (18) from the swivel (4).

Figure 5:
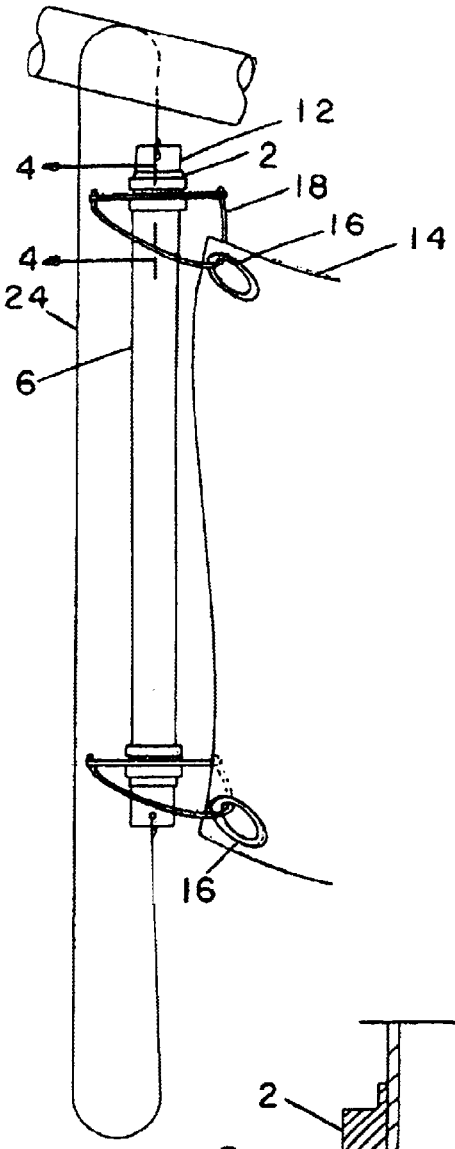
FIG. 5 is an elevational view of a supporting member supported by a halyard and with upper and lower flag fastening assemblies attached to the supporting member.
Figure 4:
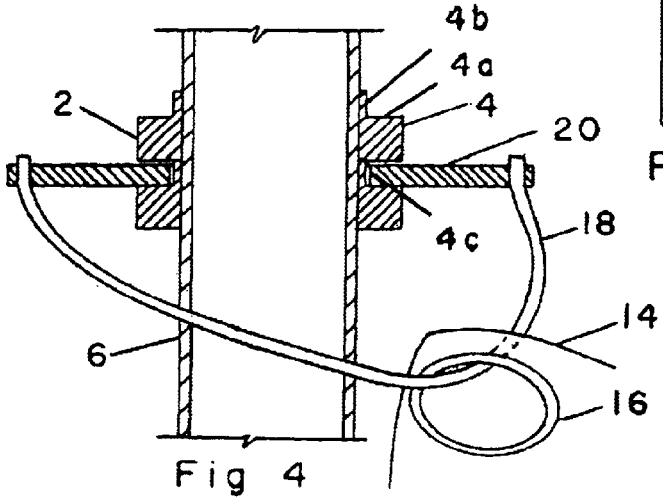
FIG. 4 is an enlarged cross-section through the upper fastening assembly as shown in FIG. 5.

FIG. 4 is a section through FIG. 5.

FIG. 5 shows an embodiment of the flag fastening assembly (2) attaching the flag (14) to a flag supporting member (6) in the form of a tube having holes at each end. It shows both grommets (16) of the flag (14) being attached to the flag fastening assemblies with a cord (18). A halyard (24) is attached to the hole in the upper end (12) of the flag supporting member (6), and the opposite end of the halyard (24) is looped over a support and attached to the hole at the opposite end of the flag supporting member (6).

The halyard (24) is attached to the flag supporting member (6) by using snap hooks, split rings, tying or in other ways. With the halyard (24) attached to the flag supporting member (6) in this way, the flag supporting member (6) can be moved in any plane about the support by pulling on the halyard (24). By attaching the halyard (24) to the flag supporting member (6) rather than to the flag (14), there is no pressure being applied to the grommets (16) or the flag (14); therefore the flag (14) is not held in a taut position, but allowed to fly freely. The flag supporting member (6) along with the flag (14) attached can be removed for storage purposes or for changing of the flag (14).

Figure 6:
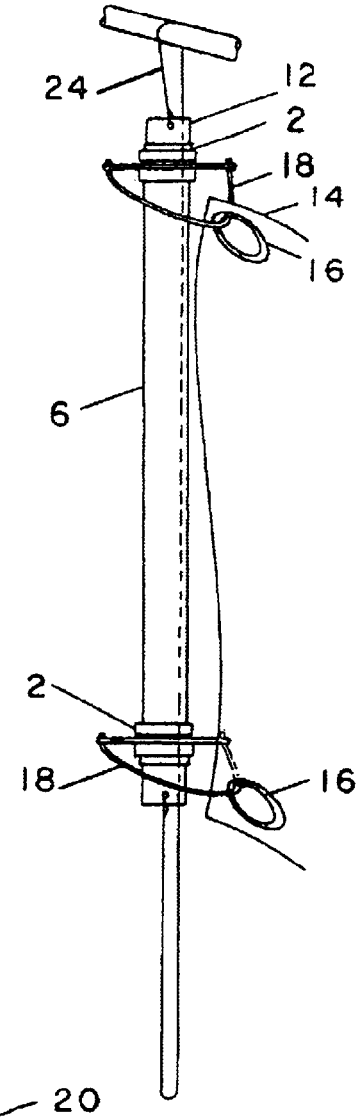
FIG. 6 is an elevational view of a supporting member supported by an internal halyard with upper and lower flag fastening assemblies attached to the supporting member.

FIG. 6 shows an embodiment of the flag fastening assembly (2) attaching the flag (14) to the flag supporting member (6) in the form of a tube having holes at each end. It shows both grommets (16) of the flag (14) being attached to the flag fastening assemblies with a cord (18). One end of the halyard (24) is attached to the hole in the upper end (12) of the flag supporting member (6) and the opposite end of the halyard (24) is looped over a support and passed through the flag supporting member (6) and attached to the opposite end of the flag supporting member (6). The halyard is attached by using snap hooks, split rings, tying or in other ways. With the halyard (24) attached to the flag supporting member (6) in this way, the halyard (24) is prevented from coming into contact with the flag (14) or the flag fastening assemblies (2). This allows the flag (14) to rotate around the flag supporting member (6) without wrapping or tangling with the halyard (24), while the flag supporting member (6) is either in an angular, a vertical or horizontal position. By attaching the halyard (24) to the flag supporting member (6) rather than to the flag (14) there is no pressure being applied to the grommets (16) or the flag (14); therefore the flag (14) is not held in a taut position, but allowed to fly freely.

Certain changes or modifications may be made in the disclosed embodiments without departing from the inventive concepts involved; it is the aid of the appended claims to cover all such changes and modifications that fall within the true spirit and scope of the present invention.

I claim:

1. A flag fastening assembly for fastening an upper portion of a flag to a flag supporting member in a manner such that said flag is rotatably balanced about the axis of said flag supporting member to prevent said flag from furling, said upper portion having grommet to protect an opening through the material of which said flag is made, the flag fastening assembly comprising:

swivel means adapted to be mounted on the flag supporting member adjacent such upper portion, said swivel means including an outwardly extending member with spaced apart holes formed therethrough; cord link means having two ends, one said end being attached to one of said spaced apart holes in said swivel means, the opposite end being attached to the other spaced apart hole in said swivel means and being adapted to pass through the grommet before being attached to the other spaced apart hole in said swivel means.

2. The flag fastening assembly of claim 1, wherein said cord link means has releasable ends for attaching to said swivel means.

3. The flag fastening assembly of claim 1, further includes attaching means for fixing said swivel means against rotation and lateral movement relative to the flag supporting member.

4. The flag fastening assembly of claim 3, wherein said attaching means are set screws.

5. The flag fastening assembly of claim 1, wherein said outwardly extending member is an annular flange that is mounted to said swivel means.

6. The flag fastening assembly of claim 5, wherein said swivel means includes two formed rings spaced one above the other forming an external annular channel wherein said outwardly extending member is freely mounted in said channel.

7. The flag fastening assembly of claim 6, wherein said external annular channel is smaller in diameter than the inside diameter of said outwardly extending member.

8. The flag fastening assembly of claim 6, wherein at least one of said formed rings includes a stepped flat surface and a circular surface for said outwardly extending member to rotate freely thereon, wherein said stepped flat surface and said circular surface for said at least one of said rings forms a portion of said external annular channel.

9. Upper and lower flag fastening assemblies for use in fastening a grommet at a respective upper and lower portion of a flag to a flag supporting member in a manner such at the flag is rotatably balanced about an axis of the flag supporting member and furling of the flag in response to wind action is prevented, each of the portions having a grommet to protect an opening through the material of which the flag is made, each of said assemblies comprising:

swivel means adapted to be mounted on the flag supporting member adjacent each of the portions, each of said swivel means including an outwardly extending member mean having in-line equally spaced apart holes therethrough about an axis of said swivel means; a car-key type ring passing through the grommet; cord link means having two ends with one end attached to one of the holes in said swivel means and the other end passing through said car-key type ring and attached to the other hole in said swivel means.

10. The assemblies of claim 9 wherein said swivel means are oppositely oriented of the flag supporting member.

11. In combination a flag supporting member and a swivel means, said swivel means including an outwardly extending member having two spaced apart attachment points wherein said swivel means is mounted over and around said flag supporting member, a cord means having two ends wherein each said end of the cord means is attached to one of said spaced apart attachment points, said cord being adapted for attaching a flag to said swivel means whereby the weight of said flag is rotatably balanced about an axis of said flag supporting member.

12. The combination as set forth in claim 11, wherein said flag supporting member comprises a hollow tube having a hole near an upper and a lower end of said flag supporting member, whereby a halyard having releasable ends is attached to said boles for easy removal of said flag supporting member.

13. The combination as set forth in claim 11, wherein said swivel means further comprises an attachment means to maintain a channel width for said outwardly extending member.

14. A method of attaching a flag supporting means to a flag having a grommet in an upper and a lower portion in a manner such that the weight of the flag being propelled around said flag supporting means by the forces of wind on the flag is balanced about an axis a said flag supporting means, comprising:

a. providing said flag supporting means wherein said flap supporting mean comprises a hollow tube with holes at each end, one said hole at an upper end and another said hole at a lower end of the tube for attaching a halyard;

b. providing a swivel means mounted around said flag supporting means and having equally spaced apart holes in line with an axis of said swivel means for attaching a cord;

c. providing said cord with means to attach said grommet to said swivel means;

d. providing attaching means on said swivel means to position said swivel means on said flag supporting means nearly adjacent said grommets.

15. The method as set forth in claim 14 further including the steps of:

a. providing the halyard having two ends an upper end and an opposite end;

b. attaching the end of said halyard to the hole at the upper end of said flag supporting means;

c. looping the opposite end of said halyard over a support;

d. passing the opposite end of said halyard through said flag supporting means;

e. attaching the opposite end of said halyard to an opposite end of said flag supporting means at the hole at the lower end of the hollow tube.

16. The method as set forth in claim 14 further including the steps of:

a. providing the halyard having an end and an opposite end;

b. attaching the end of said halyard to the hole at the upper end of said flag supporting means;

c. looping the opposite end of said halyard over a support;

d. attaching the opposite end of said halyard to the hole at the lower end the hollow tube.

17. A flag fastening assembly for attaching a flag having a grommet in an upper and a lower portion to a flag supporting member, said flag fastening assembly comprising:

a. a swivel means having a central hole therethrough for mounting over and around said flag supporting member, said swivel means having substantially equally spaced apart holes that are in line with each other and the central hole, b. a cord means for supporting and attaching the flag to said swivel means, said cord means having ends wherein each of the ends is attached to one of the equally spaced apart holes whereby the weight of the flag is equally balanced about an axis of said flag supporting member.

* * * * *